US007562921B2

(12) United States Patent
Fitzgerald

(10) Patent No.: US 7,562,921 B2
(45) Date of Patent: Jul. 21, 2009

(54) PALLET PULLING DEVICE

(76) Inventor: Joseph B. Fitzgerald, 21310 Pine Ridge Ave., Apple Valley, CA (US) 92307

( * ) Notice: Subject to any disclaimer, the term of this patent is extended or adjusted under 35 U.S.C. 154(b) by 155 days.

(21) Appl. No.: 11/825,362

(22) Filed: Jul. 7, 2007

(65) Prior Publication Data

US 2009/0008952 A1 Jan. 8, 2009

(51) Int. Cl.
*B66C 1/62* (2006.01)

(52) U.S. Cl. ..... 294/82.1; 294/92

(58) Field of Classification Search ..... 294/15, 294/26, 82.1, 89, 92, 16; 33/479, 464; 254/131
See application file for complete search history.

(56) References Cited

U.S. PATENT DOCUMENTS 467,764 A * 1/1892 Godeffroy ..... 33/468
2,768,444 A * 10/1956 Gaut, Jr. et al. ..... 33/433
3,073,613 A * 1/1963 Bergstrom, Jr. ..... 280/24
3,203,606 A * 8/1965 Masterson, Jr. ..... 294/137
4,094,544 A * 6/1978 Spaine ..... 294/82.1
4,421,353 A * 12/1983 Smith, Jr. ..... 294/82.1
4,899,680 A * 2/1990 Russell, Jr. ..... 114/230.29
6,428,069 B1 * 8/2002 Simonson, Jr. ..... 294/82.1
7,082,692 B2 * 8/2006 Shapiro ..... 33/473
D570,574 S * 6/2008 Liebenstein ..... D34/28

* cited by examiner

*Primary Examiner*—Dean J Kramer
(74) *Attorney, Agent, or Firm*—Clement Cheng

(57) ABSTRACT

A pallet pulling device includes a puller bar and a crossbar secured in a T-configuration. The crossbar plane is below the puller bar plane so the crossbar serves as a hook to exert pulling force on a plank of a pallet. The crossbar extends under the edge of a stringer of the pallet to prevent disengagement of the pulling device from the pallet when pulling force is applied. A hole is located on the flat puller bar; an outside weld opposes an inside weld, whereas both welds are adjacent to a top weld that is in opposition to the location of the hole.

14 Claims, 3 Drawing Sheets

PALLET PULLING DEVICE

BACKGROUND OF THE INVENTION

The present invention relates to devices for pulling cargo-supporting pallets used in railroad cars, trucks, warehouses, loading docks, and manufacturing facilities for the repositioning of loaded pallets for engagement and movement by forklift trucks.

DISCUSSION OF RELATED ART

Cargo is commonly supported on pallets during storage and transport in trailers, railroad cars, etc. Commonly, the pallet is a wooden platform comprised of parallel lower planks, a transverse central stringer and end boards extending edgewise across the lower planks, and parallel upper planks lying flat on the upper edges of the central stringer and end boards. The upper planks form a platform surface for supporting cargo.

Pallets loaded with cargo are transported short distances by motorized forklift trucks. A lift truck has a forwardly projecting forklift structure including two horizontally extending tines spaced apart to provide a balanced lift action on the loaded pallet. To engage the loaded pallet, the lift truck is driven forwardly so that the tines enter into spaces between the upper and lower planks on opposite sides of the stringer. The tines are then raised so that the tines lift the pallet for transport action.

In some situations the pallet may not be positioned or oriented correctly to receive the tines of the forklift. For example, the pallet may be located within a truck trailer or railroad car, or turned away from the tines or in a narrow confined space, and thus unreachable by the forklift truck. In such situations, a pallet pulling device may be connected between the selected pallet and a chain or cable attached to the forklift structure. With the pulling device attached to the selected pallet, the lift truck can be driven in a rearward direction to pull the loaded pallet to a location where the pallet tine spaces are accessible to the forklift tines. The pallet pulling device is manually attached to a pallet and later removed from the pallet quickly and conveniently without special tools or equipment.

A commercially available pallet pulling device, shown in U.S. Pat. No. 3,807,786 to Alegria, comprises two elongated jaws connected at their midpoints by a crossbar; a spreader device at the front ends of the jaws causes the rear ends of the jaws to clamp against the side faces of a pallet stringer when pulling force is applied to the spreader device, the jaws having a see-saw action.

The device of that patent is in commercial use, but has some disadvantages. It is a relatively heavy structure that is difficult to handle and attach to the pallet stringer. Also, the jaw teeth have very small area contact with the stringer surfaces so that the teeth can dig deeply into the surface, whereby the stringer material can easily be torn or ripped, especially with heavily-loaded pallets requiring substantial puller forces.

U.S. Pat. No. 4,094,544 to Spaine shows a pallet pulling device in the nature of a flat hook formed of flat bar stock bent into a hook structure. In use, the flat bar hook is positioned flatwise on the frontmost lower plank of a pallet with the downturned end of the flat hook extending downwardly behind the plant rear edge. A horizontal pulling force on the front end of the flat bar enables the downturned end of the bar to exert a pushing force on the plank rear edge.

A problem with the device of the Spaine patent is that the pulling force (by a cable or chain) must be in a horizontal direction, i.e. in the plane of the flat bar. If the pulling force is inclined, the downturned end of the hook may slip off the associated front plank of the pallet. As the downturned end of the hook slips on the plank edge surface, it can act as a ripping device to wear or tear away plank material. Once the edge of a plank is torn into a jagged condition, it cannot serve as a satisfactory surface to bear the loading imposed by the puller hook.

SUMMARY OF THE INVENTION

The present invention contemplates a puller device in some respects related to the device shown of the Spaine patent. The puller device of the invention includes a feature that prevents it from being pulled off of the front plank of a pallet, even when the pulling force is not in a horizontal plane. In one form of the invention, the pulling device comprises a flat puller bar and flat crossbar transverse to the puller bar, whereby the two bars form a generally T-shaped pulling device in the plan view. The crossbar is attached flatwise to the lower face of the puller bar so that the plane of the crossbar is below the plane of the puller bar. The crossbar can thus act as a hook to apply pushing force to the rear edge of an associated pallet plank.

The configurational arrangement of the puller bar and crossbar constitutes an important feature of the present invention. The crossbar extends transversely of the puller bar, and the pulling device is thus manipulable so that a projecting portion of the crossbar underlies the central stringer of the pallet. When engaged, the crossbar is prevented from slipping off the edge of the pallet front plank, even when pulling force is from various directions. This distinct advantage is provided by the unique engagement of the device with the pallet structure, wherein the crossbar upper face is in facial engagement with the puller bar lower face, the lower face of the puller bar is in engagement with a plank, the crossbar extending under the lower edge of a stringer, and the side edge of the cross bar engages a side edge of a plank. The crossbar thus is prevented from slipping off the edge of the pallet front plank, even when the pulling force is not precisely horizontal.

DETAILED DESCRIPTION OF THE PREFERRED EMBODIMENT

Figure 1:
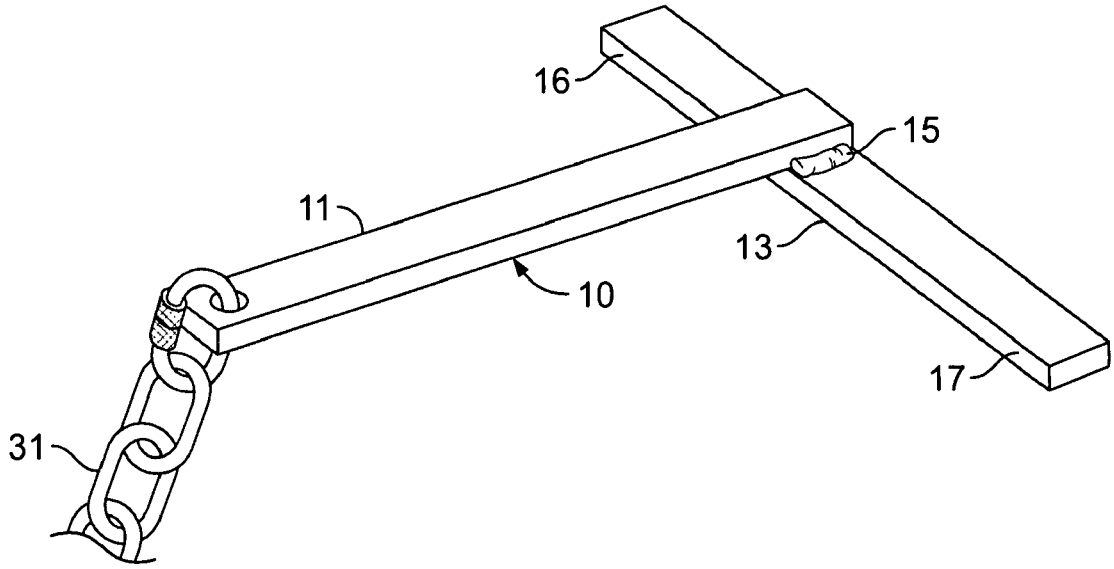
FIG. 1 is a perspective view of a pallet pulling device according to the present invention.

FIG. 1 shows a pallet pulling device 10 which comprises a flat puller bar 11 of rectangular cross-section, and a flat crossbar 13. The two bars are secured together, as by welding, at 15. The two bars are so arranged that their major flat surfaces are in facial engagement.

Crossbar 13 is attached to puller bar 11 at a position offset from the midpoint of the crossbar, so that the crossbar has a first relatively short bar portion 16 extending in one direction from the puller bar, and a second relatively long bar portion 17 extending oppositely from the puller bar. Bar portion 17 is approximately twice as long as bar portion 16. As shown, the pulling device is generally T-shaped as viewed in the top plan direction.

Figure 2:
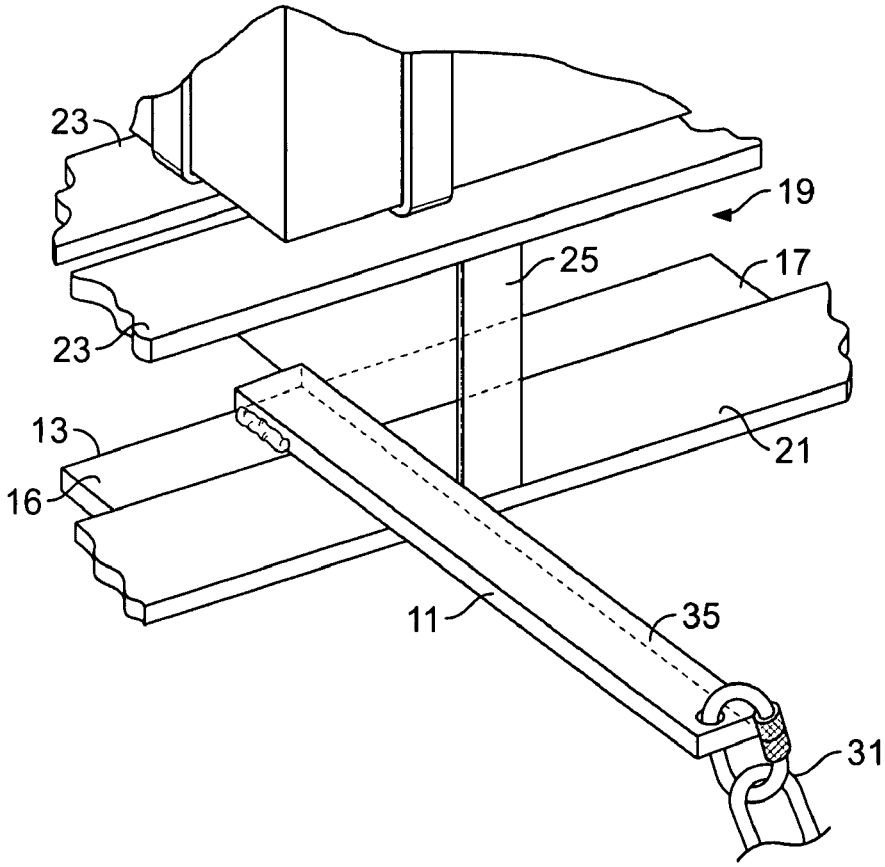
FIG. 2 is a perspective view of the FIG. 1 device in relation to a pallet structure.
Figure 3:
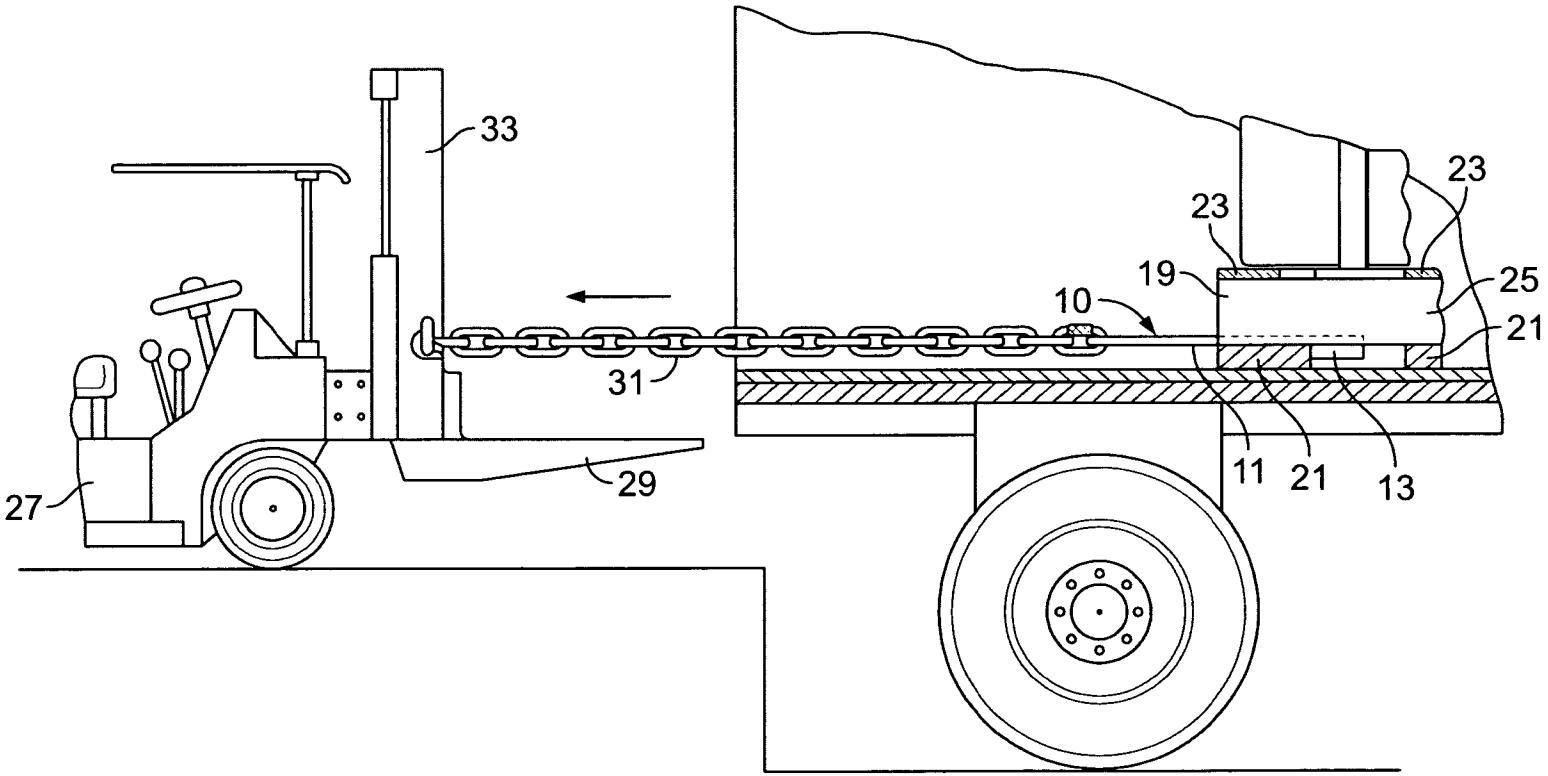
FIG. 3 is a side elevational view of a forklift truck with a chain connected to a pulling device of the invention.

FIG. 2 fragmentarily shows a portion of a conventional pallet structure 19 which comprises a series of lower planks 21, upper planks 23, and an intervening stringer 25 transverse to the planks. End boards (not shown) extend between the planks parallel to stringer 25 to form spaces on either side of the stringer adapted to receive the tines of a forklift truck. FIG. 3 shows a conventional forklift truck 27 having forwardly projecting tines 29. A chain 31 extends between pulling device 10 and the forklift structure 33, whereby the forklift truck may be driven in a reverse direction to pull the loaded pallet along the floor or bed of a road trailer, etc., to reposition the pallet to apposition accessible to tines 29.

FIG. 2 shows a manner of engagement of the pulling device with the pallet. The pulling device is so positioned that the upper face of the crossbar is in facial engagement with the lower face of the puller bar, the lower face of the puller bar is in engagement with a plank, the crossbar extends under the lower edge of a stringer, and a side edge of the cross bar engages a side edge of a plank.

The T-configuration of the pulling device is advantageous in that the device cannot be dislodge or pulled away from the pallet, even when the pulling chain 31 is not horizontal. The crossbar underlies stringer 25 so that the chain pulling force need not be in a horizontal plane. The lift structure 33 (FIG. 3) does not have to be raised or lowered to a point where chain 31 is horizontal.

The T-configuration of the pulling device is also advantageous in that the chain pulling force need not be exerted along the axis 35 of puller bar 11. Crossbar portions 16 and 17 act as stabilizer wings to maintain the pulling device in its desired orientation and engagement relative to pallet 19, even when the chain pulling force is laterally inclined relative to the puller bar axis 35, as indicated by the arrows in FIG. 2.

The crossbar portion 17 is longer than crossbar portion 16 in order to prevent sidewise slippage of the pulling device when the chain pulling force is applied obliquely and laterally to bar axis 35. As viewed in FIG. 2, stringer 25 prevents sidewise rightward slippage of the pulling device. With crossbar portion 17 relatively long, it has a relatively large area contact with the rear edge of plank 21, whereby the pulling device is frictionally held against slippage in the leftward direction when the chain force is oblique to bar axis 35 in a right-to-left direction.

Figure 4:
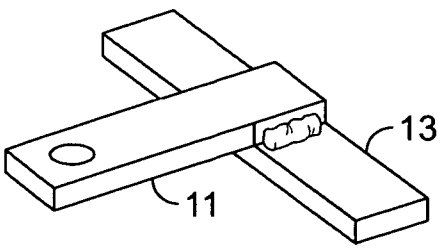
FIG. 4 is a view similar to that of FIG. 1, illustrating another embodiment of the invention.

FIG. 4 illustrates an alternate form of the invention wherein puller bar 11 is relatively short, and the projecting portions of crossbar 13 are of the same length. In major respects, the FIG. 4 device operates in the same manner as the FIG. 1 device.

In both forms of the invention, the crossbar underlies the pallet stringer 25 to prevent dislodgement of the pulling device when the chain pulling force is applied obliquely to axis 35 of the puller bar.

Figure 5:
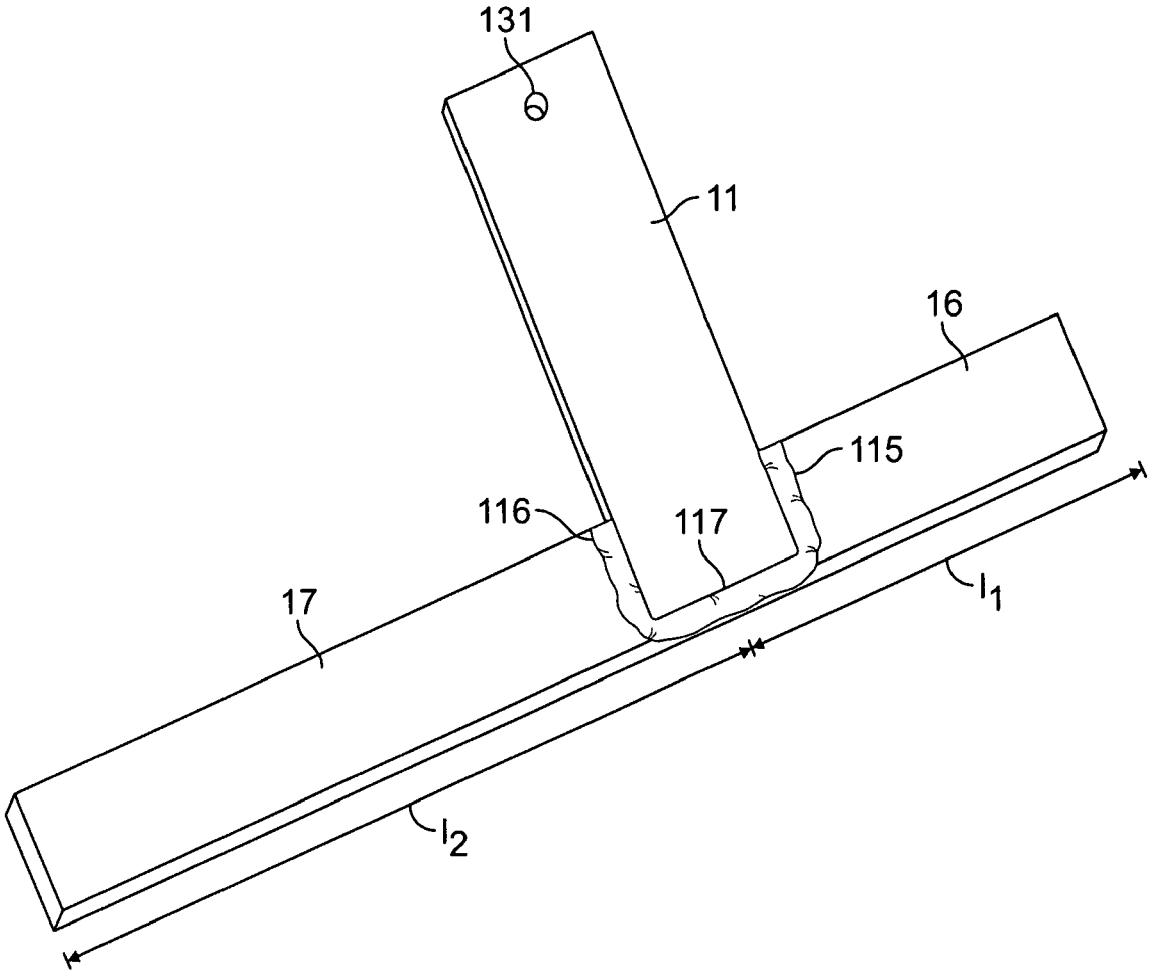
FIG. 5 is a diagram of the weld locations on the pallet pulling device.

FIG. 5 illustrates the weld locations on the device. Typically there is an outside length defined by the length $l_1$ of the short bar portion 16 and an inside length defined by the length $l_2$ Of the long bar portion 17. Although the short bar portion 16 is shown on the right and the long bar portion 17 is shown on the left, the positions can be reversed so that the short bar portion 16 can be on the left and the long bar portion 17 can be on the right. A hole 131 is located on the flat puller bar 11.

Preferably, an outside weld 115 opposes an inside weld 116, both adjacent to top weld 117 in opposition to the location of the hole 131.

Thus there has been shown and described a novel pallet pulling device which fulfills all the objects and advantages sought therefore. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The invention claimed is:

1. A method of pulling a pallet comprising the steps of:

a. fashioning a flat puller bar;

b. welding a crossbar to a bottom tip of the flat puller bar, wherein the crossbar is welded at an inside weld, an outside weld, and a top weld, whereby a pallet pulling device is formed;

c. placing the pallet pulling device so that the crossbar fits under a pallet stringer of the pallet, wherein the flat puller bar is parallel to the pallet stringer, wherein the crossbar pulls against the rear edge of a plank of the pallet;

d. applying pulling force to the flat puller bar to pull the pallet;

wherein the crossbar comprises a short bar portion and a long bar portion, wherein the long bar portion is approximately twice the length of the short bar portion.

2. The method of claim 1 further comprising the step of forming a hole on the flat puller bar opposite the top weld.

3. The method of claim 1 wherein the flat puller bar is perpendicular to the crossbar.

4. The method of claim 1 wherein the flat puller bar has a rectangular cross-section.

5. The method of claim 1 wherein the crossbar has a rectangular cross-section.

6. The method of claim 5 wherein the flat puller bar has a rectangular cross-section.

7. The method of claim 5 wherein the crossbar extends under the edge of a stringer of the pallet to prevent disengagement of the pulling device from the pallet when pulling force is applied, wherein a hole is located on the flat puller bar; an outside weld opposes an inside weld, wherein both welds are adjacent to a top weld that is in opposition to the location of the hole.

8. A method of pulling a pallet comprising the steps of:

a. fashioning a flat puller bar;

b. welding a crossbar to a bottom tip of the flat puller bar, wherein the crossbar is welded at an inside weld, an outside weld, and a top weld, whereby a pallet pulling device is formed;

c. placing the pallet pulling device so that the crossbar fits under a pallet stringer of the pallet, wherein the flat puller bar is parallel to the pallet stringer, wherein the crossbar pulls against the rear edge of a plank of the pallet;

e. applying pulling force to the flat puller bar to pull the pallet; wherein the crossbar comprises a short bar portion and a long bar portion, wherein the long bar portion is more than approximately twice the length of the short bar portion.

9. The method of claim 8 further comprising the step of forming a hole on the flat puller bar opposite the top weld.

10. The method of claim 8 wherein the flat puller bar is perpendicular to the crossbar.

11. The method of claim 8 wherein the flat puller bar has a rectangular cross-section.

12. The method of claim 8 wherein the crossbar has a rectangular cross-section.

13. The method of claim 12 wherein the flat puller bar has a rectangular cross-section.

14. The method of claim 8 wherein the crossbar extends under the edge of a stringer of the pallet to prevent disengagement of the pulling device from the pallet when pulling force is applied, wherein a hole is located on the flat puller bar; an outside weld opposes an inside weld, wherein both welds are adjacent to a top weld that is in opposition to the location of the hole.

* * * * *